US010443271B1

(12) United States Patent
Rose et al.

(10) Patent No.: US 10,443,271 B1
(45) Date of Patent: Oct. 15, 2019

(54) DRAWER LATCH SYSTEM

(71) Applicant: The Cornwell Quality Tools Company, Wadsworth, OH (US)

(72) Inventors: Wayne P. Rose, Saint Marys, OH (US); Kyle J. Everman, Celina, OH (US); Jang Sun Hong, Seongnam-si (KR)

(73) Assignee: The Cornwell Quality Tools Company, Wadsworth, OH (US)

( * ) Notice: Subject to any disclaimer, the term of this patent is extended or adjusted under 35 U.S.C. 154(b) by 0 days.

(21) Appl. No.: 16/172,914

(22) Filed: Oct. 29, 2018

(51) Int. Cl.

| | |
|---|---|
| ***A47B 95/00*** | (2006.01) |
| ***E05B 65/46*** | (2017.01) |
| ***E05C 3/04*** | (2006.01) |
| ***A47B 88/49*** | (2017.01) |

(52) U.S. Cl.
CPC ..... *E05B 65/46* (2013.01); *A47B 88/49* (2017.01); *E05C 3/045* (2013.01); *A47B 2210/0016* (2013.01); *A47B 2210/0059* (2013.01); *E05Y 2201/68* (2013.01); *E05Y 2900/20* (2013.01)

(58) Field of Classification Search
CPC ..... E05B 65/46; A47B 88/50; A47B 88/57
See application file for complete search history.

(56) References Cited

U.S. PATENT DOCUMENTS

| | | | | |
|---|---|---|---|---|
| 4,006,951 | A | 2/1977 | Geer et al. | |
| 4,947,661 | A * | 8/1990 | Yoshida | B60K 37/04 70/57 |
| 5,292,191 | A * | 3/1994 | Slivon | A47B 95/02 292/128 |
| 6,527,353 | B1 * | 3/2003 | Bradfish | E05B 65/46 292/102 |
| 6,547,289 | B1 * | 4/2003 | Greenheck | E05B 65/46 292/100 |
| 8,491,068 | B2 * | 7/2013 | Weng | A47B 88/40 312/332.1 |
| 8,596,472 | B2 * | 12/2013 | Yin | H05K 7/1489 211/26 |
| 9,422,750 | B2 * | 8/2016 | Gutierrez | E05C 3/16 |
| 9,717,335 | B2 * | 8/2017 | Zhang | A47B 88/477 |
| 10,231,540 | B1 * | 3/2019 | Hong | A47B 88/473 |
| 2008/0231154 | A1 | 9/2008 | Rudduck et al. | |
| 2009/0102333 | A1 * | 4/2009 | Weng | A47B 95/02 312/222 |
| 2011/0121701 | A1 * | 5/2011 | Chang | E05B 7/00 312/332.1 |
| 2011/0169389 | A1 * | 7/2011 | Jeffries | A47B 95/02 312/333 |

* cited by examiner

*Primary Examiner* — Matthew W Ing
(74) *Attorney, Agent, or Firm* — Renner, Kenner, Greive, Bobak; Edward Greive; Alexander Johnson

(57) ABSTRACT

A drawer assembly including a drawer, a first drawer slide carried by the drawer and a second drawer slide also carried by the drawer. Both the first and second drawer slide each include a latch lever. The drawer assembly additionally includes a drawer pull latch engaged with both latch levers such that upon movement of the drawer pull latch, opening of the drawer is permitted.

12 Claims, 5 Drawing Sheets

DRAWER LATCH SYSTEM

FIELD OF THE INVENTION

This invention relates to a drawer latch system for opening a shut drawer and for locking the drawer when closed. More particularly, this invention relates to a drawer latch system that latches a drawer in the closed position when the drawer is closed. Most particularly, this invention relates to a drawer latch system wherein the latching mechanism of the system is located within the drawer slide(s) of the drawer and wherein the releasing mechanism of the system is located within the drawer pull of the drawer.

BACKGROUND OF THE INVENTION

Conventional drawers on cargo trucks and utility cabinets, such as those used by mechanics, have drawer-slides that allow the drawers to slide in and out. The drawer-slides typically having a bearing arrangement to allow the drawer to slide easily in and out. The drawer-slides are mounted on the drawer and a support structure or housing, such as a cabinet.

Some of the drawer-slides include locking mechanisms on one or both sides of the drawer. These locking mechanisms may lock the drawer in an open or closed position or in both the open and closed positions. Such locking mechanisms are especially useful when a cargo truck is positioned on an incline to prevent the accidental opening of the drawer or when a utility cabinet contains wheels and is movable about a location.

In order to unlock the drawer, the operator must manually actuate the locking mechanism on both sides of the drawer, which is difficult or impossible to do with a single hand. As such, in order to use both hands to unlock the drawer, the operator may have to inconveniently set down their cargo or the item intended to be placed within the drawer before the drawer can be conveniently opened.

Therefore, it would highly desirable to provide a drawer and drawer latching system that is designed such that only one hand is needed to unlock the drawer. Such a latching system should be easily accessible while at the same time having a compact design and while also latching the drawer shut when the drawer is in a closed position.

SUMMARY OF THE INVENTION

It is thus an object of the one aspect of the present invention to provide a drawer latch system for opening a shut drawer and for locking the drawer when closed.

It is an object of another aspect of the invention to provide a drawer latch system, as above, wherein the latching mechanism of the system is located within the drawer slide(s) of the drawer.

It is an object of yet another aspect of the invention to provide a drawer latch system, as above, wherein the releasing mechanism of the system is located within the drawer pull of the drawer.

These and other objects of the present invention, as well as the advantages thereof over existing prior art forms, which will become apparent from the description to follow, are accomplished by the improvements hereinafter described and claimed.

In general, a drawer assembly includes a drawer, a first drawer slide carried by the drawer and a second drawer slide also carried by the drawer. Both the first and second drawer slide including a latch lever. The drawer assembly additionally includes a drawer pull latch engaged with both latch levers such that upon movement of the drawer pull latch, opening of the drawer is permitted.

A preferred exemplary drawer latch system according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
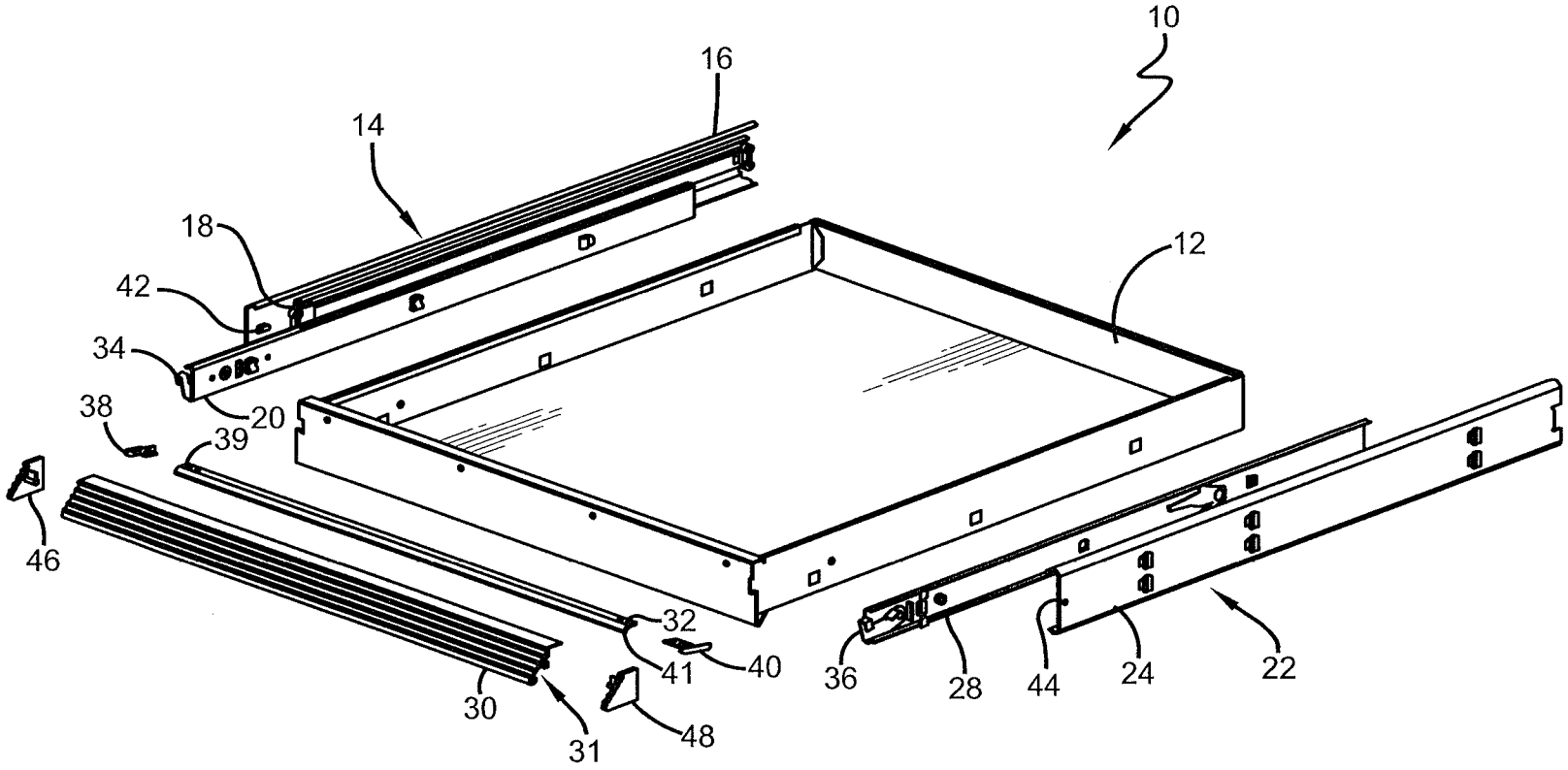
FIG. 1 is an exploded perspective view of the drawer latch system of the present invention.

An embodiment of a drawer assembly made in accordance with the present invention is generally indicated by the numeral 10. As shown in FIG. 1, drawer assembly 10 includes a drawer 12 having a left drawer slide assembly 14 includes an outer drawer slide member 16, a middle drawer slide member 18, and an inner drawer slide member 20. Drawer assembly 10 additionally includes a right drawer slide assembly 22 includes an outer drawer slide member 24, a middle drawer slide member (not shown), and an inner drawer slide member 28. Drawer slide assemblies 14 and 22 allow for drawer 12 to be pulled open from a cabinet or the like.

Drawer assembly 10 also includes a drawer pull 30 and a drawer pull latch lever 32. In one embodiment of the present invention, when drawer assembly 10 is completely assembled, drawer pull latch 32 will be positioned within a chamber 31 of drawer pull 30 such that drawer pull latch 32 will be positioned in a hidden position underneath the drawer pull 30. The hidden position of drawer pull latch 32 provides the drawer assembly 10 of the present invention with a more compact design and allows for more of the drawer front of drawer 12 to be visible.

In addition to the drawer pull latch 32, the drawer latch system of the present invention includes a left drawer slide latch lever 34 and a right drawer slide latch lever 36. Although drawer assembly 10 is shown in FIG. 1 as containing both a left and a right drawer slide latch lever, 34, 36, it is also contemplated that the present invention could include just a single drawer slide latch lever. As shown in FIG. 1, left drawer slide latch lever 34 is positioned within the interior of the left drawer slide assembly 14, specifically positioned on the inner drawer slide member 20, and the right drawer slide latch lever 36 is positioned within the interior of the right drawer slide assembly 22, specifically positioned on the inner drawer slide member 28.

The drawer latch system of the present invention additionally includes a left engaging member 38 and a right engaging member 40. The left engaging member 38 is attached to and extends from the left end 39 of the drawer pull latch lever 32, and the right engaging member 40 is attached to and extends from the right end 41 of the drawer pull latch lever 32. Additionally, the drawer latch system of the present invention includes a left catch member 42 located on the outer drawer slide member 16 and a right catch member 44 located on the outer drawer slide member 24. In order to shield the various elements of the drawer latch system from the environment, the drawer assembly system 10 can also include a left end cap 46 and a right end cap 48.

Figure 2:
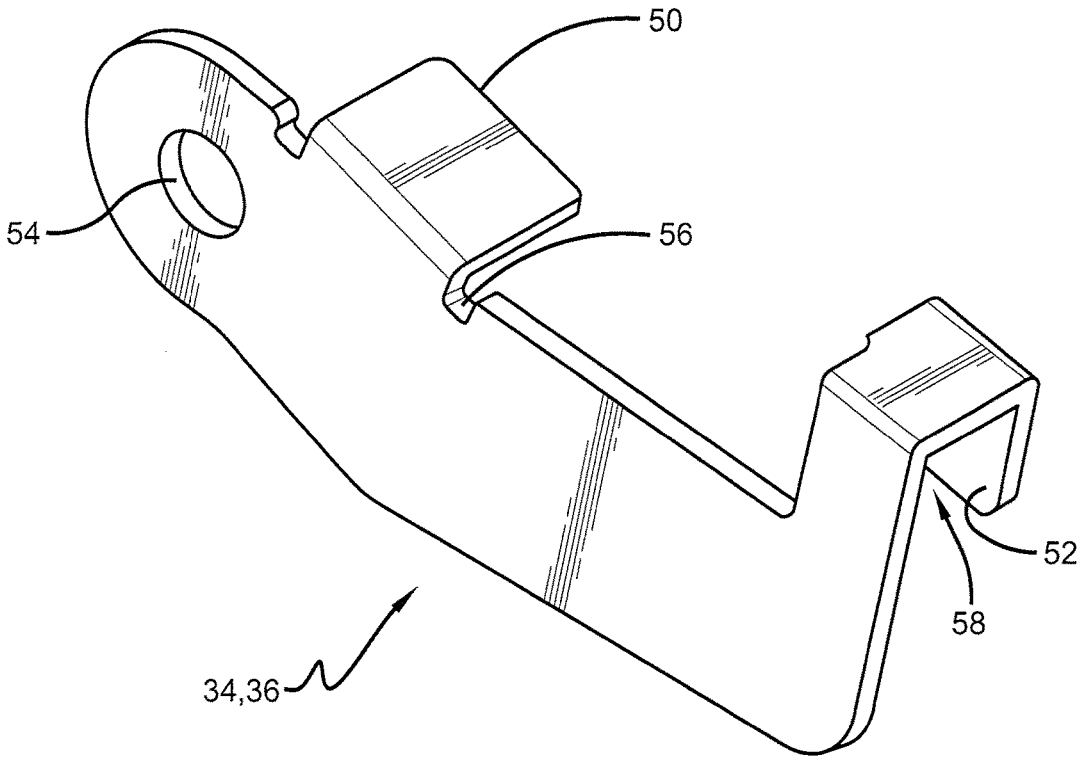
FIG. 2 is a perspective view of a latch lever component of the present invention.

The details of the drawer slide latch levers 34, 36 are shown in FIG. 2. Drawer slide latch levers 34, 36 include a catch member 50, a latch hook member 52, an aperture 54, and a spring attachment pocket 56. Aperture 54 is utilized so as to use an attachment means, such as a screw, to attach the drawer slide latch lever 34, 36 to the appropriate inner drawer slide member 20, 28. Catch member 50 is utilized so as to interact with the appropriate catch member 42, 44 when drawer 12 is in a latched position, as will be explained below in further detail. Latch hook member 52 is utilized so as to interact with the appropriate engaging member 38, 40. Specifically, the appropriate engaging member 38, 40 engages with hook portion 58 of the latch hook member 52.

When in a latched position, catch member 50 of each drawer slide latch lever 34, 36 will interact with catch member 42, 44, respectively, in a manner such that drawer 12 of drawer assembly 10 will not be able to be opened. When in a latched position, the interaction of the catch member 50 of each drawer slide latch lever 34, 36 with catch members 42, 44 will not allow drawer 12 to be opened.

Figure 3A:
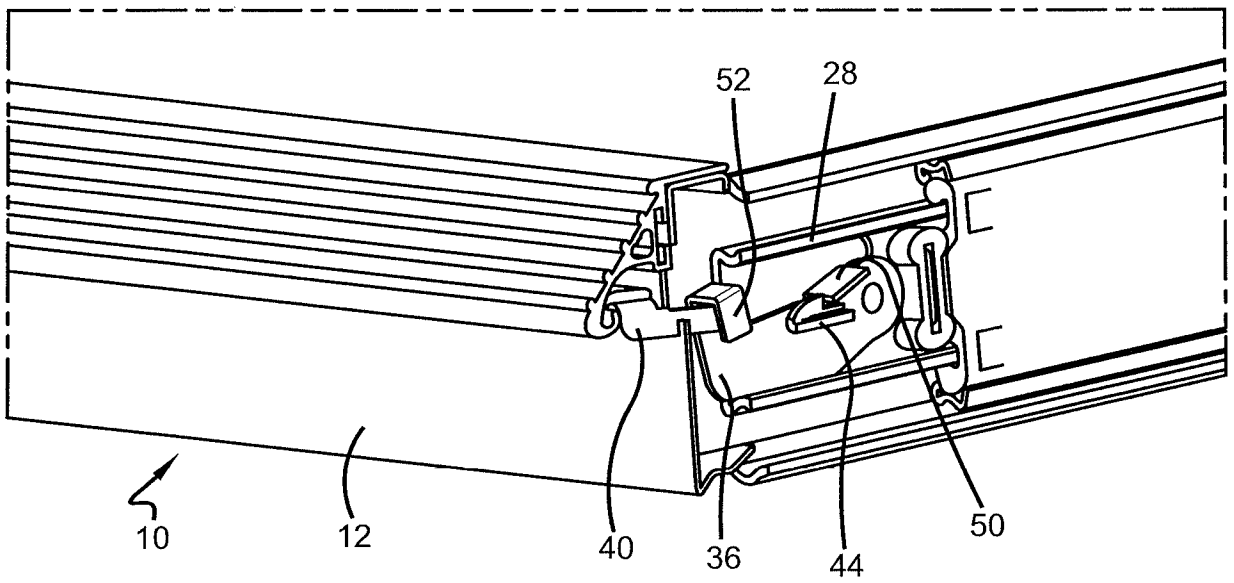
FIG. 3A is a perspective view showing components of the drawer latch system of FIG. 1 in a latched position.
Figure 3B:
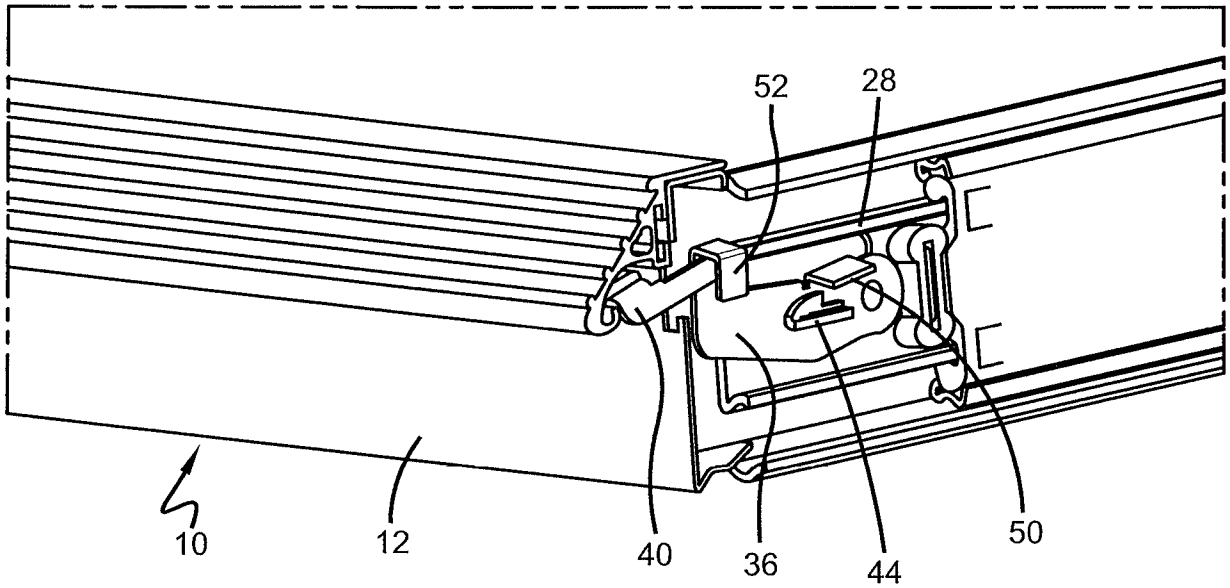
FIG. 3B is a perspective view showing components of the drawer latch system of FIG. 1 in an unlatch position.

To open drawer 12, drawer pull latch lever 32 needs to be activated. Activation of drawer pull latch lever 32 occurs by an upward force of pressure being applied to drawer pull latch lever 32. As stated previously, each latch hook member 52 of drawer slide latch lever 34, 36 interacts with the respective engaging member 38, 40. The hook portion 58 of the latch hook member 52 and the appropriate engaging member 38, 40 will be engaged with one another regardless of whether drawer 12 is in a latched position or an open position. This relationship is shown in FIGS. 3A and 3B which show the positioning of the various elements of the drawer latch system when the drawer pull latch lever 32 is in an un-activated state (FIG. 3A) and when the drawer pull latch lever 32 is in an activated state (FIG. 3B). FIGS. 3A and 3B have the outer drawer slide member 24 removed from the figure such that only the catch member 44 is shown.

Figure 4:
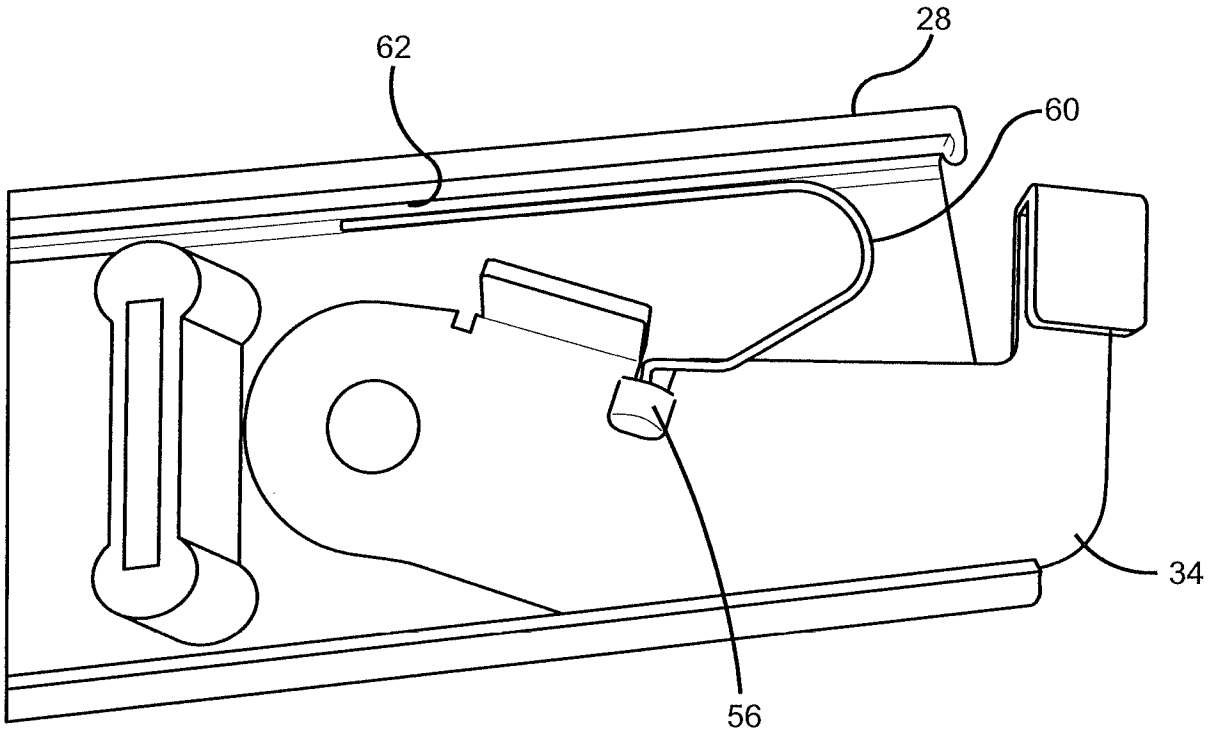
FIG. 4 is a perspective view of the latch lever component of FIG. 2 positioned within a drawer slide component of the present invention.

The final element of the drawer latch system of the drawer assembly 10 of the present invention is a torsion spring 60. As shown in FIG. 4, torsion spring 60 is positioned on the inner drawer slide member 20 of the left drawer slide 14. In one embodiment of the present invention, there is a similar spring 60 positioned on the inner drawer slide member 28 of the right drawer slide 22. More specifically, torsion spring 60 is positioned between a top edge 62 of the inner drawer slide member 20 and the left drawer slide latch lever 34, that is, an end of torsion spring 60 is positioned within spring attachment pocket 56 of the left drawer slide latch lever 34. Torsion spring 60 provides enough force to the latch lever 34 such that latch lever 34 remains engaged by catch member 42 when drawer 12 is in a latched position.

As shown in FIG. 3A, when drawer 12 is in a latched position, and the drawer pull latch lever 32 is in an un-activated state, catch member 44 will interact with catch member 50 of latch lever 36 such that latch lever 36 will not be able to bypass catch member 44. This relationship makes certain that drawer 12 of drawer assembly 10 will remain in a latched position unless it is desirable for drawer 12 to be opened.

When it is desirable for drawer 12 to be opened, an upward force of pressure needs to be applied to drawer pull latch lever 32. Once this upward pressure has been applied, engaging member 40 will act on hook portion 58 of the latch hook member 52 in such as way so as to counteract the force being applied by torsion spring 60, such as shown in FIG. 3B. This action will lift up catch member 50 of latch lever 36 out of its interaction with catch member 44. Once catch member 50 is able to bypass catch member 44, drawer 12 can then be pulled open.

When it is desirable for drawer 12 to be closed, drawer 12 simply needs to be pushed back to its latched position and the force of drawer 12 moving back will allow for catch member 50 to ride over catch member 44 such that drawer 12 will return back into a latched position.

In light of the foregoing, it should be appreciated that the present invention accomplishes the objects of the present invention and otherwise significantly advances the art by providing a drawer latch system that is structurally and functionally improved in a number of ways.

What is claimed is:

1. A drawer assembly comprising a drawer, a first drawer slide carried by said drawer and including a first latch lever, a second drawer slide carried by said drawer and including a second latch lever, and a drawer pull latch engaging said first and second latch levers such that upon movement of said drawer pull latch, opening of said drawer is permitted, wherein each of said first and second latch levers each include a catch member, a latch hook member, an aperture, and a spring attachment pocket.

2. The drawer assembly of claim 1 further comprising a drawer pull.

3. The drawer assembly of claim 2, wherein said drawer pull latch is positioned in a hidden position within a cavity of said drawer pull.

4. The drawer assembly of claim 1, wherein said first latch lever is pivotably attached to said first drawer slide and said second latch lever is pivotably attached to said second drawer slide.

5. The drawer assembly of claim 1, further comprising a first engaging member extending from a first end of the drawer pull latch, and a second engaging member extending from a second end of the drawer pull latch.

6. The drawer assembly of claim 5, wherein said first engaging member engages said latch hook member of said first latch lever and said second engaging member engages said latch hook member of said second latch lever to allow for a sliding movement of the drawer.

7. The drawer assembly of claim 6, wherein each of said first and second drawer slides include an outer drawer slide member, a middle drawer slide member, and an inner drawer slide member.

8. The drawer assembly of claim 7, wherein said first latch lever is attached to said inner drawer slide member of said first drawer slide and said second latch lever is attached to said inner drawer slide member of said second drawer slide.

9. The drawer assembly of claim 8, wherein said outer drawer slide members of each of said first drawer slide and said second drawer slide include a catch member.

10. The drawer assembly of claim 9, wherein said catch members of each said latch levers interacts with the catch members of said outer drawer slide members to keep said drawer in a latched position.

11. The drawer assembly of claim 10, further comprising a first spring located at a position between a top edge of said inner drawer slide member of said first drawer slide and said first latch lever, and a second spring located at a position between a top edge of said inner drawer slide member of said second drawer slide and said second latch lever.

12. The drawer assembly of claim 11, wherein an end of said first spring is positioned within said spring attachment pocket of said first latch lever and wherein an end of said second spring is positioned within said spring attachment pocket of said second latch lever.

* * * * *